US009604449B2

(12) United States Patent
Nakada

(10) Patent No.: US 9,604,449 B2
(45) Date of Patent: Mar. 28, 2017

(54) IMAGE FORMING APPARATUS, ROLL PRINT MEDIUM CONVEYANCE CONTROL METHOD AND NON-TRANSITORY COMPUTER READABLE RECORDING MEDIUM

(71) Applicant: Kikuya Nakada, Kanagawa (JP)

(72) Inventor: Kikuya Nakada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/482,079

(22) Filed: Sep. 10, 2014

(65) Prior Publication Data

US 2015/0077457 A1 Mar. 19, 2015

(30) Foreign Application Priority Data

Sep. 13, 2013 (JP) ..... 2013-190674

(51) Int. Cl.

| | |
|---|---|
| ***B41J 29/38*** | (2006.01) |
| ***B41J 2/01*** | (2006.01) |
| ***B41J 11/42*** | (2006.01) |
| ***B41J 15/04*** | (2006.01) |
| ***B41J 2/32*** | (2006.01) |

(52) U.S. Cl.

CPC . *B41J 2/01* (2013.01); *B41J 2/32* (2013.01); *B41J 11/42* (2013.01); *B41J 15/04* (2013.01); *B65H 2511/10* (2013.01); *B65H 2511/114* (2013.01); *B65H 2511/142* (2013.01); *B65H 2515/706* (2013.01)

(58) Field of Classification Search

USPC ..... 347/15, 16, 12, 14

See application file for complete search history.

(56) References Cited

U.S. PATENT DOCUMENTS

| | | | | |
|---|---|---|---|---|
| 4,017,036 A * | 4/1977 | Bates | B65H 23/1806 242/418 |
| 6,256,474 B1 * | 7/2001 | Gibisch | B41J 11/46 226/2 |
| 6,369,918 B1 * | 4/2002 | Tom | H04N 1/047 250/578.1 |
| 8,322,644 B2 | 12/2012 | Nakada et al. | |
| 8,465,146 B2 | 6/2013 | Satoh et al. | |

(Continued)

FOREIGN PATENT DOCUMENTS

| | | |
|---|---|---|
| JP | 2004-074708 | 3/2004 |
| JP | 2011-178497 | 9/2011 |

*Primary Examiner* — Matthew Luu
*Assistant Examiner* — Lily Kemathe
(74) *Attorney, Agent, or Firm* — Cooper & Dunham LLP

(57) ABSTRACT

An image forming apparatus includes a roll that is a print medium in a roll-like shape; a conveyor for conveying the print medium that is pulled out from the roll; a conveyance controller for controlling a driving source of the conveyor, so that a conveyance amount of the print medium reaches a target conveyance amount; a detector for detecting information that is correlated with power increase of the driving source during conveyance of the print medium; and a corrector correcting, when the information that is correlated with the power increase of the driving source is detected, the target conveyance amount toward an increasing direction.

4 Claims, 8 Drawing Sheets

(56) References Cited

U.S. PATENT DOCUMENTS

| | | | | |
|---|---|---|---|---|
| 8,690,314 | B2 * | 4/2014 | Castells De Monet | B41J 11/001 347/101 |
| 8,998,368 | B2 * | 4/2015 | Igarashi | B41J 15/04 347/104 |
| 2003/0193522 | A1 * | 10/2003 | Chandhoke | G05B 19/416 715/764 |
| 2007/0059078 | A1 * | 3/2007 | Silverbrook | B41J 11/001 400/614 |
| 2008/0106773 | A1 * | 5/2008 | Akiyama | H04N 1/047 358/496 |
| 2008/0239052 | A1 * | 10/2008 | Ishii et al. | 347/104 |
| 2010/0123751 | A1 * | 5/2010 | Iesaki | B41J 29/38 347/16 |
| 2011/0211031 | A1 * | 9/2011 | Satoh et al. | 347/104 |
| 2012/0032021 | A1 | 2/2012 | Morinaga et al. | |
| 2012/0087707 | A1 * | 4/2012 | Igarashi | 400/611 |
| 2013/0126659 | A1 | 5/2013 | Nakada | |
| 2013/0222457 | A1 | 8/2013 | Nakada et al. | |

* cited by examiner

| PWM COMMAND VALUE | VOLTAGE CONVERSION | DUTY RATIO |
|---|---|---|
| 4000 | +24V | +100% |
| 2000 | 0V | 50% |
| 0 | −24V | 0% |

IMAGE FORMING APPARATUS, ROLL PRINT MEDIUM CONVEYANCE CONTROL METHOD AND NON-TRANSITORY COMPUTER READABLE RECORDING MEDIUM

BACKGROUND OF THE INVENTION

1. Field of the Invention

The present invention relates to an image forming apparatus, a roll print medium conveyance control method, and a non-transitory computer readable recording medium storing a program.

2. Description of the Related Art

As an image forming apparatus, such as a printer, a facsimile machine, a copier, a plotter and a multifunction peripheral thereof, an inkjet recorder has been known. Such an inkjet recorder may be an image forming apparatus based on a liquid discharge recording method. In the liquid discharge recording method, a liquid discharge head for discharging liquid droplets (a liquid droplet discharge head) may be utilized, for example.

As a print medium, a roll may be used that is formed by winding a print medium in a roll-like shape. In an image forming apparatus that uses a roll as a print medium, a conveyance load may vary depending on a residual amount of the roll.

Accordingly, an image forming apparatus has been invented such that a conveyance amount is compensated for depending on a residual amount (Patent Document 1 (Japanese Unexamined Patent Publication No. 2004-74708)).

SUMMARY OF THE INVENTION

Inertia of a roll relative to conveyance force may vary depending on a size of a print medium (i.e., the roll). Accordingly, an optimum correction amount for correcting a conveyance amount may not be obtained only from the residual amount of the roll. In addition, conveyance force may vary depending on a type of the print medium to be used. Thus, it may be difficult to obtain the optimum correction amount.

Due to variation in size and/or in type of the print medium, during conveyance, actual slippage of the print medium may be different from estimated slippage. Accordingly, even if the compensation is applied to the conveyance amount, image quality can be degraded. Such a phenomenon may be significant especially for high-speed printing.

It is desirable that conveyance accuracy of a print medium is stably improved, and that image quality is improved.

According to an aspect of the present invention, there is provided an image forming apparatus including a roll that is a print medium in a roll-like shape; a conveyor configured to convey the print medium that is pulled out from the roll; a conveyance controller configured to control a driving source of the conveyor, so that a conveyance amount of the print medium reaches a target conveyance amount; a detector configured to detect information that is correlated with power increase of the driving source during conveyance of the print medium; and a corrector configured to correct, when the information that is correlated with the power increase of the driving source is detected, the target conveyance amount toward an increasing direction.

According to another aspect of the present invention, there is provided a roll print medium conveyance control method that is for controlling a driving source of a conveyor configured to convey a print medium that is pulled out from a roll that is the print medium in a roll-like shape, so that a conveyance amount of the print medium reaches a target conveyance amount. The method includes a detection step of detecting information that is correlated with power increase of the driving source during conveyance of the print medium; and a correction step of correcting, when the information that is correlated with the power increase of the driving source is detected, the target conveyance amount toward an increasing direction.

According to another aspect of the present invention, there is provided a non-transitory computer readable recording medium storing a program for causing a computer to execute a roll print medium conveyance control method that is for controlling a driving source of a conveyor configured to convey a print medium that is pulled out from a roll that is the print medium in a roll-like shape, so that a conveyance amount of the print medium reaches a target conveyance amount. The method includes a detection step of detecting information that is correlated with power increase of the driving source during conveyance of the print medium; and a correction step of correcting, when the information that is correlated with the power increase of the driving source is detected, the target conveyance amount toward an increasing direction.

According to an embodiment of the present invention, conveyance accuracy for conveying a print medium can be stably improved, and image quality can be improved.

Other objects, features and advantages of the present invention will become more apparent from the following detailed description when read in conjunction with the accompanying drawings.

DETAILED DESCRIPTION OF THE PREFERRED EMBODIMENTS

Figure 1:
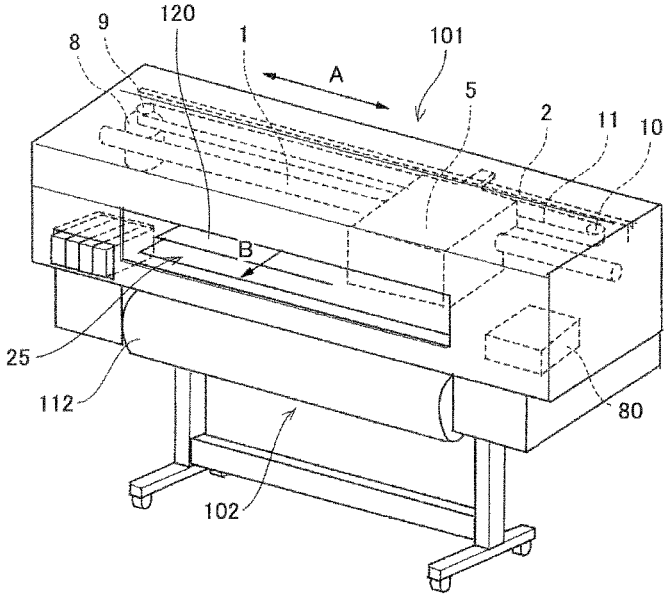
FIG. 1 is an external perspective view illustrating an example of an image forming apparatus according to an embodiment of the present invention.
Figure 2:
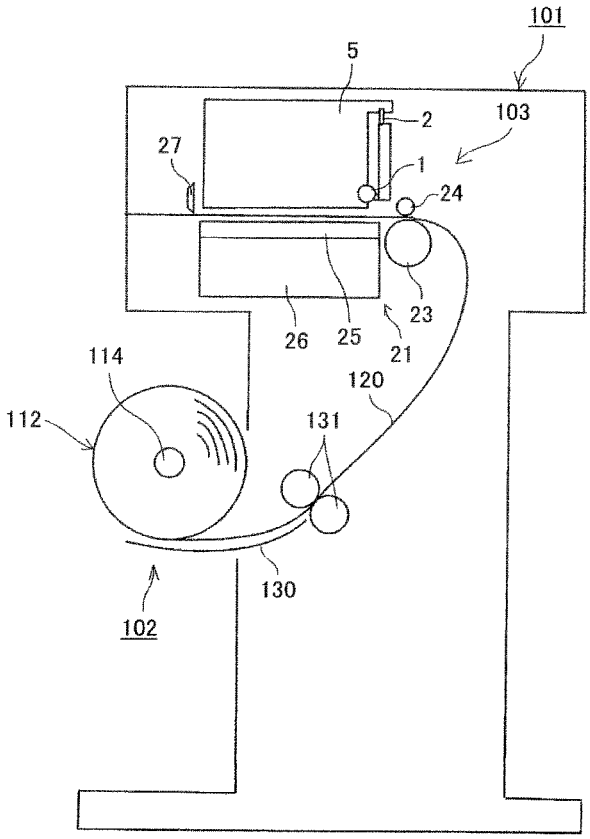
FIG. 2 is a schematic side view illustrating the image forming apparatus.
Figure 3:
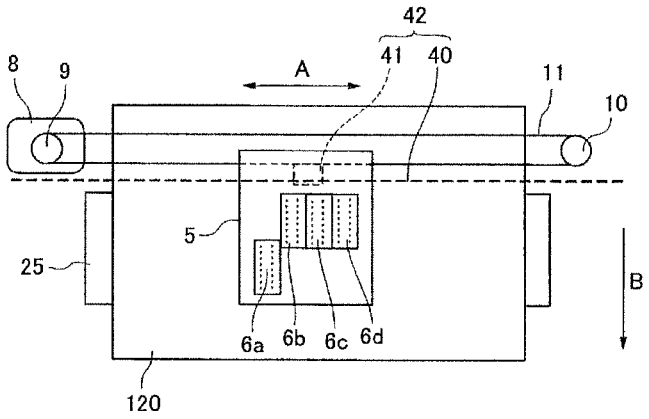
FIG. 3 is a plan view illustrating a main part in an image forming unit of the image forming apparatus.

An embodiment of the present invention is explained below by referring to the accompanying drawings. An example of an image forming apparatus according to the embodiment of the present invention is explained by referring to FIGS. 1 to 3. FIG. 1 is an external perspective view illustrating the image forming apparatus. FIG. 2 is a schematic side view illustrating the image forming apparatus. FIG. 3 is a diagram illustrating a major portion of the image forming apparatus.

The image forming apparatus is a serial-type image forming apparatus. The image forming apparatus includes an apparatus main body 101 and a sheet feeder 102 that is arranged below the apparatus main body 101. The sheet feeder 102 is supposed to be arranged below the apparatus main body 101 as a device that is separated from the apparatus main body 101. However, for convenience, the sheet feeder 102 is shown together with the apparatus main body 101 in FIG. 2.

An image forming unit 103 is provided inside the apparatus main body 101. The image forming unit 103 is an image forming unit for forming an image on a roll sheet 120 that is a roll medium fed from the sheet feeder 102.

In the image forming unit 103, a guide rod 1 and a guide stay 2, which are guide members, bridge laterally between two side plates (not shown). A carriage 5 is supported by the guide rod 1 and the guide stay 2, so that the carriage 5 can be move in the arrow A direction (a main-scanning direction, or a carriage traveling direction).

A main-scanning motor 8 is arranged on one side in the main-scanning direction. The main-scanning motor 8 is a driving source for reciprocating the carriage 5. A timing belt 11 is wound around a drive pulley 9 and a driven pulley 10. The drive pulley 9 is rotationally driven by the main-scanning motor 8. The driven pulley 10 is arranged on the other side in the main-scanning direction. A belt holding portion (not shown) of the carriage 5 is fixed to the timing belt 11.

Accordingly, when the main-scanning motor 8 drives, the carriage 5 is reciprocated in the main-scanning direction.

A plurality of recording heads 6*a* to 6*d* (i.e., four pieces of the recording heads 6*a* to 6*d*) is mounted on the carriage 5. Here, when the recording heads 6*a* to 6*d* are not distinguished, the recording heads 6*a* to 6*d* are collectively referred to as a "recording head 6." The recording heads 6*a* to 6*d* are integrated with a head tank for supplying a liquid to liquid discharge heads (recording heads 6*a* to 6*d*).

In a sub-scanning direction, the recording head 6*a* is disposed at a position that is shifted from a position at which the recording head 6*b* to 6*d* are disposed by a distance corresponding to one head (i.e., a distance corresponding to one nozzle sequence). The sub-scanning direction is perpendicular to the main-scanning direction. The recording head 6 is mounted on the carriage 5 such that a nozzle sequence formed of a plurality of nozzles for discharging liquid droplets is arranged in the sub-scanning direction (which is perpendicular to the main scanning direction) and a droplet discharge direction is directed downward.

Each of the recording heads 6*a* to 6*d* includes two nozzle sequences. Each of the nozzle sequences of each of the recording heads 6*a* and 6*b* is for discharging liquid droplets in the same color that is black. One of the nozzle sequences of the recording head 6*c* is for discharging cyan (C) liquid droplets, and the other nozzle sequence of the recording head 6*c* is not used. One of the nozzle sequences of the recording head 6*d* is for discharging yellow (Y) liquid droplets, and the other nozzle sequence of the recording head 6*d* is for discharging magenta (M) liquid droplets.

In this manner, for a monochrome image, an image having a width of two heads can be formed per single scanning (main scanning) by using the recording heads 6*a* and 6*b*. A color image can be formed, for example, by using the recording heads 6*b* to 6*d*. However, a head configuration is not limited to this example. For example, a head may have a configuration such that a plurality of recording heads is arranged on the same line in the main scanning direction.

Each color of ink is supplied from an ink cartridge to the head tank of the recording head 6 through a corresponding supply tube. Here, each of the ink cartridges is a main tank that is replaceably attached to the apparatus main body 101.

An encoder sheet 40 is arranged along the traveling direction of the carriage 5. The carriage 5 includes a encoder sensor 41 that reads information on the encoder sheet 40. The encoder sheet 40 and the encoder sensor 41 form a linear encoder 42. A position and a moving rate of the carriage 5 are detected from an output of the linear encoder 42.

In a recording area in a main-scanning area of the carriage 5, the roll sheet 120 is fed from the sheet feeder 102. Then, the roll sheet 120 is discontinuously conveyed by a conveyor 21 (a conveyance unit 21) in a direction perpendicular to the main-scanning direction of the carriage 5 (i.e., the sub-scanning direction or a sheet conveyance direction: the direction of the arrow B).

The conveyor 21 includes a conveyance roller 23 and a pressure roller 24. The conveyance roller 23 is for conveying the roll sheet 120 that is the roll medium fed from the sheet feeder 102. The pressure roller 24 is arranged to face the conveyance roller 23. Additionally, the conveyor 21 includes a conveyance guide member 25 and a suction fan 26 that are arranged at a downstream side of the conveyance roller 23. A plurality of suction holes is formed in the conveyance guide member 25. The suction fan 26 is a suction means for suctioning through the suction holes of the conveyance guide member 25.

As shown in FIG. 2, a cutter 27 is arranged at a downstream side of the conveyor 21. The cutter 27 is for cutting the roll sheet 120 (on which the image is formed by the recording head 6) to a predetermined length.

Additionally, a maintenance and recovery mechanism 80 is arranged at one side in the main-scanning direction of the carriage 5. The maintenance and recovery mechanism 80 is arranged at a side of the conveyance guide member 25. The maintenance and recovery mechanism 80 is for performing maintenance and recovery of the recording head 6.

The sheet feeder 102 includes a roll 112. The roll 112 is formed in such a manner that the sheet 120 (i.e., the "roll sheet") that is a long roll-shaped medium is wound around a tube 114. The tube 114 is a core member.

In the embodiment, as the roll 112, the roll sheet 120 can be used such that an end edge of the roll sheet 120 is fixed to the tube 114 with adhesive (e.g., by gluing) or the like. Alternatively, as the roll 112, the roll sheet 120 can be used such that an end edge of the roll sheet 120 is not fixed to the tube 114 with adhesive (e.g., by gluing, or the like.

Inside the apparatus main body 101, there are provided a guide member 130 and a conveyance roller pair 131. The guide member 130 is for guiding the roll sheet 120 that is pulled out from the roll 112 of the sheet feeder 102. The conveyance roller pair 131 is for feeding the roll sheet 120 upward by bending the roll sheet 120.

By rotationally driving the conveyance roller pair 131, the roll sheet 120 that is pulled out from the roll 112 is conveyed in such a state that the roll sheet 120 spans between the conveyance roller pair 131 and the roll 112. Then, the roll sheet 120 is fed to the nip between the conveyance roller 23 and the pressure roller 24 of the conveyor 21 after passing through the conveyance roller pair 131.

In the image forming apparatus having such a configuration, the carriage 5 is moved in the main-scanning direction, and the roll sheet 120 that is fed from the sheet feeder 102 is discontinuously conveyed by the conveyor 21. Then, the recording head 6 is driven in accordance with image information (print information), so that the recording head 6 discharges the liquid droplets. In this manner, a desired image is formed on the roll sheet 120. The roll sheet 120 on which the image is formed is cut to a predetermined length by the cutter 27. Then, the roll sheet 120 is guided by an ejection guide member (not shown) that is disposed at a front side of the apparatus main body 101, and the roll sheet 120 is ejected and stored inside a bucket.

Figure 4:
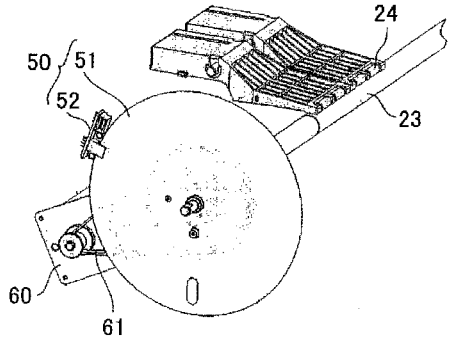
FIG. 4 is a perspective view of the vicinity of a conveyance roller, which illustrates an outline of conveyance control by the image forming apparatus.

Next, an outline of the conveyance control is explained by referring to FIG. 4. FIG. 4 is a perspective view illustrating the vicinity of the conveyance roller 23.

An encoder wheel 51 is attached to a shaft of the conveyance roller 23. In the apparatus main body 101, an encoder sensor 52 for reading information on the encoder wheel 51 is provided. The encoder wheel 51 and the encoder sensor 52 form a rotary encoder 50.

The conveyance roller 23 can be rotationally driven by a sub-scanning motor 60 through a timing belt 61 or the like. The sub-scanning motor 60 is a driving source of the conveyance unit 21 (which is the conveyor 21).

Based on a detection output from the rotary encoder 50 and a target conveyance amount, feedback control of the motor 60 is executed. In this manner, a conveyance amount of the roll sheet 120 is controlled by a rotation amount of the conveyance roller 23.

Figure 5:
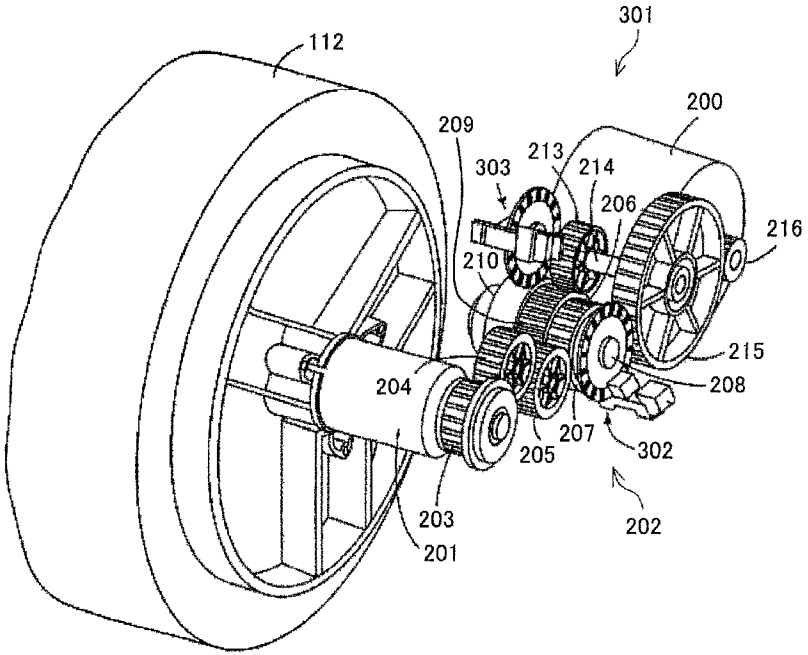
FIG. 5 is a perspective view illustrating an example of a back tension mechanism of the image forming apparatus.

Next, a back tension mechanism (a load application unit 301) is explained by referring to FIG. 5. FIG. 5 is a perspective view illustrating the back tension mechanism.

A rotation transmission mechanism 202 is connected to a spool shaft 201 of the roll 112. The rotation transmission mechanism 202 is also connected to a drive motor 200. By controlling a rotation state of the drive motor 200, a load is applied to the spool shaft 201 of the roll 112, and back tension is applied to the roll sheet 120 to be conveyed. Namely, the load application unit 301 is formed of the drive motor 200 and the rotation transmission mechanism 202.

Hereinafter, the rotation transmission mechanism 202 is explained. The spool shaft 201 is attached to the tube 114 of the roll 112. A driven gear 203 is attached to the spool shaft 201. The driven gear 203 is rotated as the spool shaft 201 is rotated. The driven gear 203 is coupled to a unidirectional clutch 207 including a gear 206 through idler gears 204 and 205.

A gear 209 and a torque limiter 210 are provided to a shaft 208 of the unidirectional clutch 207. There is also provided a rotary encoder 302 for detecting a rotation amount of the shaft 208. By detecting the rotation amount of the shaft 208, a residual amount of the roll sheet 120 can be detected.

The gear 209 engages a transmission gear 213. The gear 209 engages a drive gear 216 of the drive motor 200 through an idler gear 215 that is provided to a shaft 214 of the transmission gear 213. There is also provided a rotary encoder 303 that detects rotation of the shaft 214. The rotary encoder 303 can detect rotational speed of the drive motor 200.

In the load application unit 301 having such a configuration, the back tension can be controlled to be in three modes, which are strong (reverse rotation), middle (non-power supply state), and weak (normal rotation), by selecting one of three drive states of the drive motor 200, which are the normal rotation, the reverse rotation and the non-power supply state.

To briefly explain this point, for setting the back tension to be middle, the drive motor 200 is set to be a non-excitation state. By doing this, when the roll 112 is rotated in a feed direction and the spool shaft 201 is rotated, a load that is for rotating all the elements from the rotation transmission mechanism 202 to the drive motor 200 occurs on the rotation of the spool shaft 201, and this results in the back tension to the roll sheet 120.

For setting the back tension to be weak, the drive motor 200 is to be normally rotated, so that the gear 209 rotates faster than the gear 206 of the unidirectional clutch 207. By doing this, the gear 206 of the unidirectional clutch 207 idles relative to the shaft 208. In this manner, a load that is for rotating the gear 206 of the unidirectional clutch 207 through the idler gears 204 and 205 is applied to the spool shaft 201 of the roll 112. However, the back tension applied to the roll sheet 120 is weaker compared to the case in which the drive motor 200 is in the non-excitation state.

For setting the back tension to be strong, the drive motor 200 is to be reversely rotated. By doing this, the rotation direction of the shaft 208 by the drive motor 200 and the rotation direction of the gear 209 by the feeding of the roll 112 are reversed. Thus, excessive torque that exceeds the limit of the torque limiter 210 is generated, and torque transmission is cut off. The shaft 208 rotates in the torque limiter 210 while sliding. The resistance force received due to sliding of the shaft 208 in the torque limiter 210 results in a load applied to the rotating spool shaft 201, and thereby strong back tension is applied to the roll sheet 120.

Figure 6:
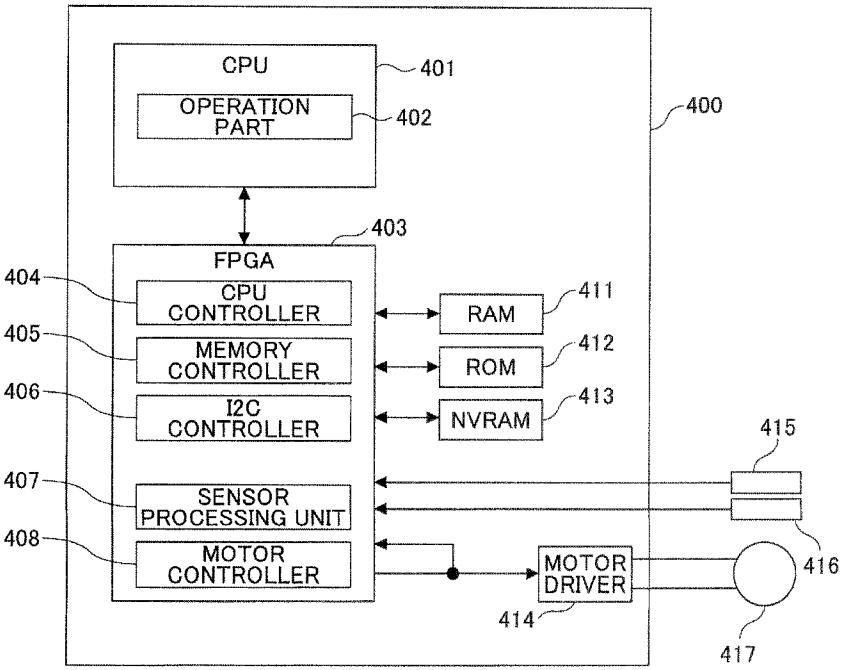
FIG. 6 is a block diagram illustrating an outline of a controller of the image forming apparatus.

Next, an outline of a controller of the image forming apparatus is explained by referring to the block diagram shown in FIG. 6.

A controller 400 includes a CPU 401, a Field Programmable Gate Array (FPGA) 403, a RAM 411, a ROM 412, a NVRAM 413, a motor driver 414, and so forth.

An operation part 402 of the CPU 401 is for communicating with each component of the FPGA 403.

FPGA 403 includes a CPU controller 404; a memory controller 405; and an I2C controller 406. The CPU controller 404 is for communicating with the CPU 401. The memory controller 405 is for accessing a memory, such as the ROM 412 and the RAM 411. The I2C controller 406 is for communicating with the NVRAM 413.

Additionally, the FPGA 403 includes a temperature and humidity sensor 415, and a sensor processing unit 407. The temperature and humidity sensor 415 is a unit for detecting ambient temperature and ambient humidity of the apparatus. The sensor processing unit 407 is for processing a sensor signal from encoder sensors 416, for example. The sensor processing unit 407 forms a generating unit for generating a position signal and a speed signal of the carriage 5 from an output signal from the linear encoder 42.

Furthermore, the FPGA 403 includes a motor controller 408. The motor controller 408 is for driving and controlling each of motors 417 including the main-scanning motor 8.

Here, the encoder sensors 416 includes the encoder sensor 41 of the linear encoder 42 that is for detecting the position and the speed of the carriage 5; the encoder sensor 52 of the rotary encoder 50 that is for detecting a rotation amount of the conveyance roller 23; and an encoder sensor including the rotary encoder 302 of the load application unit 301, for example.

Further, the motors 417 include the above-described main-scanning motor 8; the sub-scanning motor 60 for rotationally driving the conveyance roller 23; and the drive motor 200 for rotationally driving the conveyance roller pair 131, for example. As a motor, a DC motor and/or a stepping motor can be used, for example.

Hereinafter, an operation of the sub-scanning motor 60, which is included in the motors 417, is explained.

The CPU 401 specifies moving speed and a moving distance to the motor controller 408 together with a command for starting operation.

After receiving the instruction from the CPU 401, the motor controller 408 creates a drive profile from the speed specifying information and the moving distance specifying information, and the motor controller 408 compares the drive profile with encoder information that is obtained from the encoder sensor 52 (which is included in the encoder sensors 416) through the sensor processing unit 407. Then, the motor controller 408 calculates a pulse width modulation (PWM) command value, and the motor controller 408 outputs the PWM command value to the motor driver 414.

After completing a predetermined operation, the motor controller 408 reports to the CPU 401 that the operation is completed, and the CPU 401 receives the indication that the operation is completed.

Here, instead of creating the drive profile by the motor controller 408, the CPU 401 may create the drive profile, and the CPU 401 may command the motor controller 408.

Namely, the CPU 401 and the motor controller 408 form a drive control unit for driving and controlling, by the PWM control, the sub-scanning motor 60 that is the driving source of the conveyance controller.

Further, in the embodiment, the CPU 401 forms a detection unit for detecting information that is correlated with increase in the output of the sub-scanning motor 60 during conveyance of the roll sheet 120; and a correction unit for correcting, when the information that is correlated with the increase in output of the sub-scanning motor 60 is detected, the target conveyance amount toward an increasing direction.

Figures 7, 8:
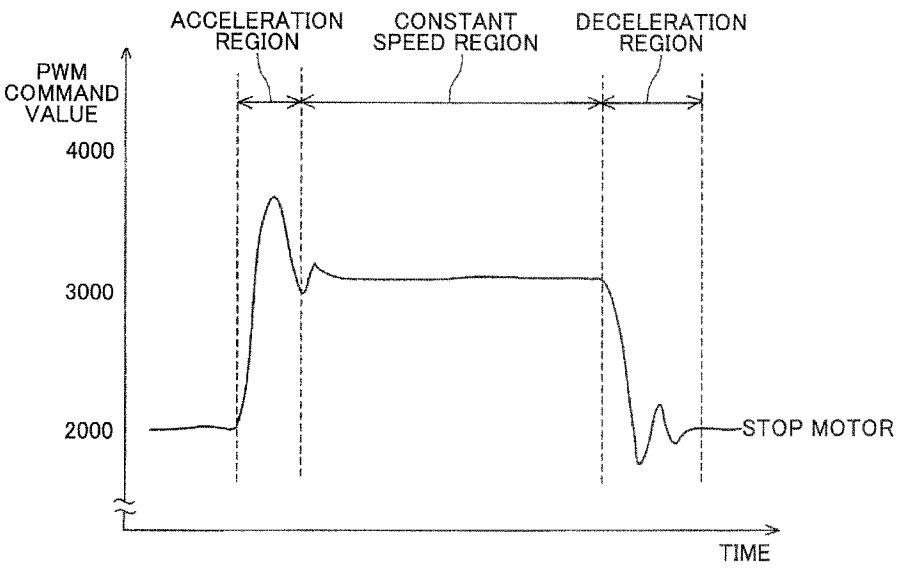
FIG. 7 is a diagram illustrating a command value variation of a duty ratio of a pulse width modulation (PWM) value of a conveyance rate during single normal rotation (feeding operation) of the conveyance roller.
FIG. 8 is a diagram illustrating an example of a PWM command value.

Next, an example of conveyance control is explained by referring to FIG. 7. FIG. 7 is a diagram illustrating a command value variation in a duty ratio of the PWM value of the conveyance speed during a single normal operation (feeding operation) of the conveyance roller 23.

In this embodiment, drive control of the sub-scanning motor 60 for rotating the conveyance roller 23 is executed by the PWM control. The drive control is executed by a servo system including a PI control loop. In this system, the speed of the conveyance roller 23 is controlled by varying a command value for determining the duty ratio of the pulse width modulation (which is referred to as the "PWM command value," hereinafter).

Here, the PWM value is assigned as shown in FIG. 8, for example.

As described above, the example is explained in which the speed of motor is controlled by controlling the duty ratio of the pulse width modulation (PWM).

First, a velocity error (Ve) is calculated by subtracting moving speed of a controlled object (which is the conveyance roller 23) or rotational speed of a motor from externally specified speed. Here, each of the moving speed of the controlled object and the rotational speed of the motor may be detected by a unit for detecting a position and speed, such as an encoder.

Next, in accordance with the formula (1), a control input (which is the duty ratio of the PWM) is calculated. In the formula (1), $K_p$ is a proportional gain constant, and $K_i$ is an integral gain constant.

$$PWM=K_p\times V_e+K_i\times\int V_e\cdot dt \quad (1)$$

Speed control of the conveyance roller 23 is executed by varying a PWM command value to be provided to the motor driver 414 in accordance with the calculated value.

In this embodiment, the proportional-integral (PI) control is adopted. However, the embodiment is not limited to this. For example, the proportional-integral-derivative (PID) control may be adopted.

Referring to FIG. 7 again, the speed control of the conveyance roller 23 is as follows. After activation of the sub-scanning motor 60, the conveyance roller 23 is gradually accelerated in an acceleration region. Subsequently the control mode transitions to a constant speed control mode (i.e., the control region transitions to a constant speed region). As a target position (a target conveyance amount) approaches, the control region transitions to a deceleration region. Then, the speed of the sub-scanning motor 60 is quickly reduced, and the sub-scanning motor 60 is stopped.

Figure 9:
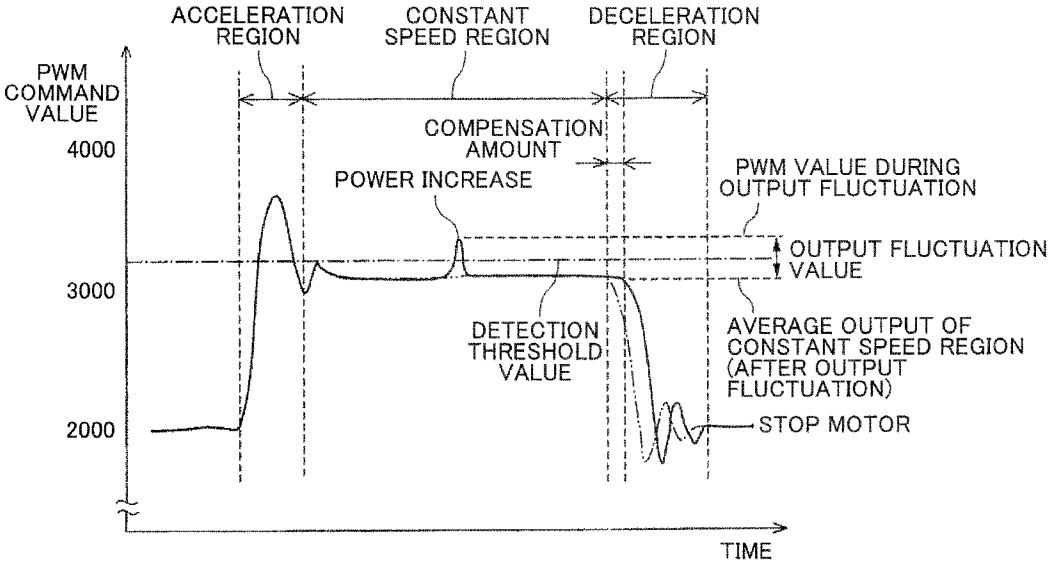
FIG. 9 is a diagram illustrating an example of the command value variation of the duty ratio of the PWM of the conveyance roller when a slip occurs during conveyance of roll paper.

Next, there is explained detection of information that is correlated with power increase of the sub-scanning motor 60 during conveyance of the roll sheet 120 by referring to FIG. 9. FIG. 9 is a diagram illustrating an example of a command value variation of the duty ratio of the PWM of the conveyance roller 23 when slip occurs during conveyance of the roll sheet 120.

During the constant speed control in the constant speed control region, when the back tension from the roll 112 is too strong, slip may occur. Accordingly, a feedback control system executes control, so that the PWM command value is increased. Namely, when slip occurs on feeding of a print medium during conveyance of the print medium, the control is executed in the direction toward increasing the output of the driving source.

By determining whether there is an output of the PWM command value that exceeds a predetermined detection threshold value prior to transition to the deceleration region, the information that is correlated with the power increase of the sub-scanning motor 60 can be obtained during conveyance of the roll sheet 120.

When there exists an output of the PWM command value that exceeds the detection threshold value (which is referred to as the "output fluctuation"), difference between the output of the PWM command value and an average output of the PWM command value within the constant speed region after the output fluctuation (i.e., an output fluctuation value) is stored, and a compensation amount that is for increasing the target conveyance amount is calculated based on the output fluctuation value and other parameters, such as the size and the residual amount of the roll 112.

By continuing conveyance by the calculated compensation amount, a shortage of the conveyance amount that is due to the slip of the roll sheet 120 can be compensated for, and the actual conveyance amount can be adjusted to the original target conveyance amount. In this manner, high-precision conveyance can be achieved.

Figure 10:
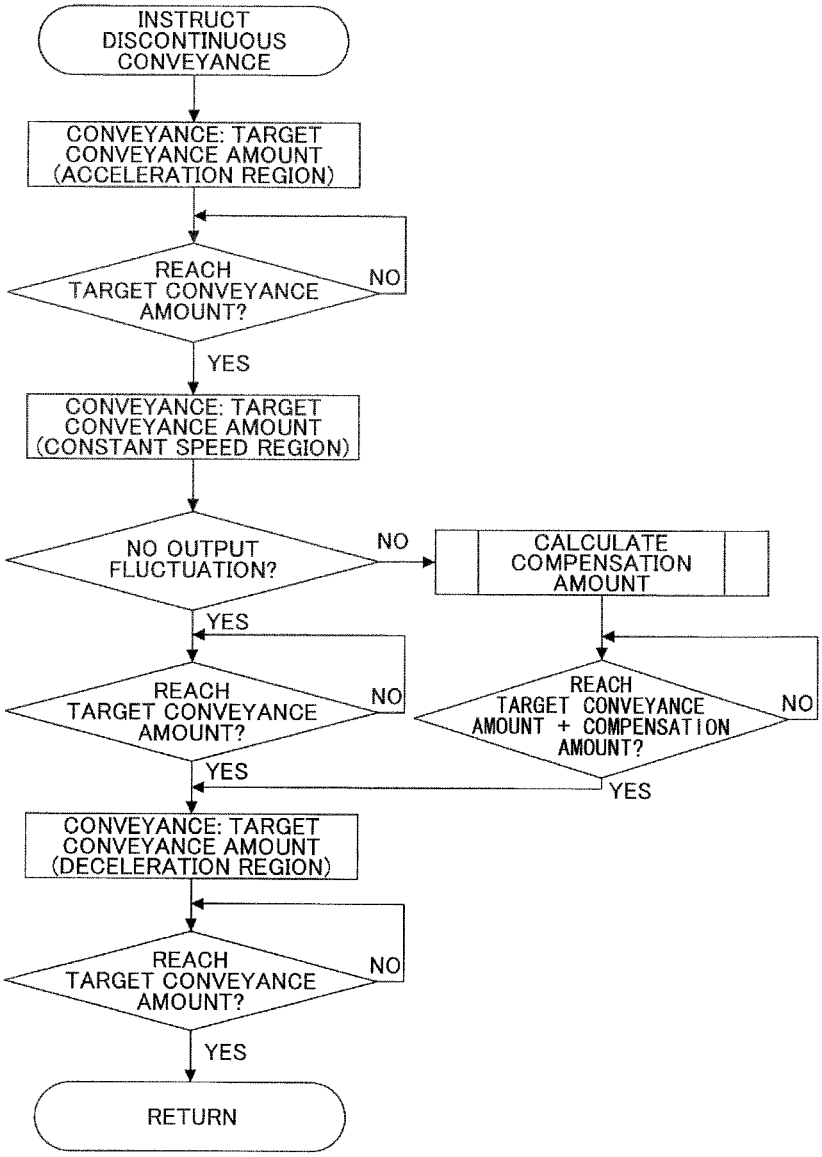
FIG. 10 is a flowchart illustrating an example of drive control of a sub-scanning motor by the controller.

Next, there is explained an example of the drive control of the sub-scanning motor 60 by the controller 400 by referring to the flowchart of FIG. 10.

When an instruction for discontinuous conveyance is received, the driving of the sub-scanning motor 60 is started, and the roll sheet 120 is conveyed until a target conveyance amount for the acceleration region is reached. When the conveyance amount reaches the target conveyance amount for the acceleration region, the roll sheet 120 is conveyed in the constant speed region until a target conveyance amount for the constant speed region is reached.

Then, a determination is made as to whether the output fluctuation exists or not.

When the output fluctuation does not exist, and when the target conveyance amount for the constant speed region is reached, the roll sheet 120 is conveyed in the deceleration region until a target conveyance amount for the deceleration region is reached. When the target conveyance amount for the deceleration region is reached, the driving of the sub-scanning motor 60 is stopped.

In contrast, when the output fluctuation exists, the difference between the output of the PWM command value and the average output of the PWM command value within the constant speed region after the output fluctuation (i.e., the output fluctuation value) is stored, and the compensation amount that is for increasing the target conveyance amount is calculated based on the output fluctuation value and other parameters, such as the size and the residual amount of the roll 112.

When the conveyance amount reaches the amount obtained by adding the compensation amount to the target conveyance amount for the constant speed region, the roll sheet 120 is conveyed in the deceleration region until the target conveyance amount for the deceleration region is reached. When the conveyance amount reaches the target conveyance amount for the deceleration region, the driving of the sub-scanning motor 60 is stopped.

In the above-described control method, detection of the information that is correlated with the power increase of the driving source (the sub-scanning motor 60) during the conveyance of the print medium is made by detecting the PWM command value variation. However, the embodiment is not limited to this.

For example, the power increase of the driving source may be detected by detecting the variation of the speed of the conveyance roller 23 itself. In such a case, the output fluctuation may be calculated from the variation amount of the speed of the conveyance roller 23, and thereby the compensation amount may be determined.

The compensation for the target conveyance amount is made at the timing at which the control region transitions to the deceleration region. However, the embodiment is not limited to this. For example, the compensation for the target conveyance amount may be made by varying the acceleration in the deceleration region.

In this manner, the roll print medium can be conveyed while the target conveyance amount is corrected by the proper compensation amount based on the size, the residual amount and the slippage of the roll print medium. Therefore, conveyance accuracy of the print medium can be stably increased, and the image quality can be enhanced.

In the above-described embodiment, each processing related to the control of the sub-scanning motor 60 is executed by a computer (the CPU 401) that executes a program stored in the ROM 412, for example. The program may be provided by distributing a storage medium storing the program. Alternatively, the program may be provided by downloading via a network, such as the Internet.

In the present specification, the "sheet" is not limited to a paper sheet. The "sheet" can be a transparency, a piece of cloth, a glass sheet or a substrate, for example. The "sheet" may refer to something to which ink droplets or droplets of other liquids can be adhered. The "sheet" may include what is referred to as the medium to be recorded on, the recording medium, the recording paper, the recording sheet, and so forth. In addition, image formation, recording, typing, imaging and printing are regarded as synonyms.

The "image forming apparatus" means an apparatus for forming an image by discharging a liquid onto a medium, such as paper, a thread, a fiber, fabric, leather, metal, a plastic, glass, timber, or ceramics. Further, the "image formation" means not only to print an image having meaning, such as characters and figures, but also to print an image having no meaning, such as patterns (simply causing liquid droplets to land onto a medium).

Further, the "ink" is not limited to what is referred to as ink, unless specifically limited otherwise. The "ink" is used as a general term for all liquids with which an image can be formed, such as a recording liquid, a fixing liquid, and a liquid. Examples of the "ink" include a DNA sample, a resist, a pattern material, and a resin.

Additionally, the "image" is not limited to a planar image. Examples of the "image" include an image formed on a three-dimensionally shaped object and a three-dimensionally formed image.

The image forming apparatus and the roll print medium conveyance control method are explained above by the embodiment. However, the present invention is not limited to the specifically disclosed embodiment, and variations and modifications may be made within the scope of the present invention. Specific examples of numerical values are used in order to facilitate understanding of the invention. However, these numerical values are simply illustrative, and any other appropriate values may be used, except as indicated otherwise. The separations of the sections of the specification are not essential to the present invention. Depending on necessity, subject matter described in two or more sections may be combined and used, and subject matter described in a section may be applied to subject matter described in another section (provided that they do not contradict). A boundary of a functional unit or a processing unit in a functional block may not correspond to a boundary of a physical component. An operation by a plurality of functional units may be physically executed by a single component. Alternatively, an operation by a single functional unit may be physically executed by a plurality of components.

The present invention can be implemented in any convenient form, for example using dedicated hardware, or a mixture of dedicated hardware and software. The present invention may be implemented as computer software implemented by one or more network processing apparatuses. The network can comprise any conventional terrestrial or wireless communications network, such as the Internet. The processing apparatuses can comprise any suitable programmed apparatuses such as a general purpose computer, a personal digital assistant, a mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, a hard disk, a CD ROM, a magnetic tape device or a solid state memory device. The hardware platform includes any desired hardware resources including, for example, a central processing unit (CPU), a random access memory (RAM), and a hard disk drive (HDD). The CPU may include processors of any desired kinds and numbers.

The RAM may include any desired volatile and nonvolatile memories. The HDD may include any desired nonvolatile memories capable of recording a large amount of data. The hardware resources may further include an input device, an output device, and a network device in accordance with the type of the apparatus. The HDD may be provided external to the apparatus as long as the HDD is accessible from the apparatus. In this case, the CPU, for example, the cache memory of the CPU, and the RAM may operate as a physical memory or a primary memory of the apparatus, while the HDD may operate as a secondary memory of the apparatus.

The present application is based on and claims the benefit of priority of Japanese Priority Application No. 2013-190674 filed on Sep. 13, 2013, the entire contents of which are hereby incorporated herein by reference.

What is claimed is:

1. An image forming apparatus comprising:

a roll that is a print medium in a roll-like shape;

a conveyor to convey the print medium that is pulled out from the roll in a conveyance direction;

a conveyance controller to control a driving source of the conveyor, so that a conveyance amount of the print medium reaches a target conveyance amount;

a detector to detect information that is correlated with power increase of the driving source during conveyance of the print medium in the conveyance direction; and wherein when the information that is correlated with the power increase of the driving source is detected, the conveyance controller corrects the target conveyance amount toward the conveyance direction by continuing conveyance of the print medium by a calculated compensation amount in the conveyance direction, to compensate for a slippage occurring during the conveyance of the print medium, and in a case in which a value of the power increase to compensate for the slippage exceeds a predetermined threshold value, the conveyance controller adjusts the compensation amount based on a difference between the power increase value and a value corresponding to an average conveyance speed.

2. The image forming apparatus according to claim 1, wherein an amount of the correction is calculated in accordance with at least one of an amount related to the power increase of the driving source, a size of the print medium, and a residual amount of the roll.

3. A roll print medium conveyance control method that is for controlling a driving source of a conveyor configured to convey, in a conveyance direction, a print medium that is pulled out from a roll that is the print medium in a roll-like shape, so that a conveyance amount of the print medium reaches a target conveyance amount, wherein the method comprises:

detecting information that is correlated with power increase of the driving source during conveyance of the print medium in the conveyance direction;

correcting, when the information that is correlated with the power increase of the driving source is detected, the target conveyance amount toward the conveyance direction by continuing conveyance of the print medium by a calculated compensation amount in the conveyance direction, to compensate for a slippage occurring during the conveyance of the print medium; and adjusting, in a case in which a value of the power increase to compensate for the slippage exceeds a predetermined threshold value, the compensation amount based on a difference between the power increase value and a value corresponding to an average conveyance speed.

4. A non-transitory computer readable recording medium storing a program for causing a computer to execute a roll print medium conveyance control method that is for controlling a driving source of a conveyor configured to convey a print medium that is pulled out from a roll that is the print medium in a roll-like shape in a conveyance direction, so that a conveyance amount of the print medium reaches a target conveyance amount, wherein the method comprises:

detecting information that is correlated with power increase of the driving source during conveyance of the print medium in the conveyance direction;

correcting, when the information that is correlated with the power increase of the driving source is detected, the target conveyance amount toward the conveyance direction by continuing conveyance of the print medium by a calculated compensation amount in the conveyance direction, to compensate for a slippage occurring during the conveyance of the print medium; and adjusting, in a case in which a value of the power increase to compensate for the slippage exceeds a predetermined threshold value, the compensation amount based on a difference between the power increase value and a value corresponding to an average conveyance speed.

* * * * *